United States Patent [19]

Boylett

[11] 4,105,393

[45] Aug. 8, 1978

[54] FUEL BURNERS

[75] Inventor: William Frederick Boylett, Ormskirk, England

[73] Assignee: Consultant Gas Engineer Limited, England

[21] Appl. No.: 685,677

[22] Filed: May 12, 1976

Related U.S. Application Data

[63] Continuation-in-part of Ser. No. 531,187, Dec. 9, 1974, abandoned.

[30] Foreign Application Priority Data

Dec. 7, 1973 [GB] United Kingdom ..... 56860/73

[51] Int. Cl.[2] ..... F23M 9/02

[52] U.S. Cl. ..... 431/116; 431/182; 431/187; 431/351; 431/158; 239/403; 239/406; 239/424

[58] Field of Search ..... 431/278, 279, 284, 285, 431/181, 182, 185, 187, 188, 173, 158, 353, 116, 174, 183, 351; 126/91 A; 239/424, 425, 400, 403, 406, 422

[56] References Cited

U.S. PATENT DOCUMENTS

| | | | |
|---|---|---|---|
| 2,368,178 | 1/1945 | Turpin | 431/284 |
| 2,393,887 | 1/1946 | Clements | 431/284 |
| 2,594,094 | 4/1952 | Todd | 431/284 |
| 2,850,875 | 9/1958 | Gahwyler | 60/29.82 P |
| 2,898,978 | 8/1959 | Kitchen et al. | 431/158 |
| 2,935,128 | 5/1960 | Ferguson | 431/284 |
| 2,973,032 | 2/1961 | Reilly et al. | 431/284 |
| 3,275,057 | 9/1966 | Ward | 431/284 |
| 3,602,621 | 8/1971 | Mellett | 431/116 |
| 3,857,672 | 12/1974 | Reed et al. | 431/173 |

*Primary Examiner*—Carroll B. Dority, Jr.

*Attorney, Agent, or Firm*—Scrivener, Parker, Scrivener & Clarke

[57] ABSTRACT

In a fluent fuel burner using a flame anchor plate, secondary air from a plenum leaves the plenum through a restricted passage so that the secondary air is at high velocity and correspondingly low pressure and this low pressure is used to suck the flame to the rim of the anchor plate. Two dual fuel burners are described in which a gaseous fuel introduction means has an enlarged end portion which extends from within the air plenum into a combustion space, the said portion having slots in it to allow primary air to enter the said portion to serve as primary air for combustion, and which has associated with it a flame anchor plate. The plenum has a wall on the combustion side with a hole in it. In one embodiment, the anchor plate overlies the rim of the hole so that a narrow annular passage defined between the plate and the wall directs the secondary air in a radial blast. In the other embodiment, the passage is between the rim of the plate and the rim of the hole so that the air exits in a cylindrical jet about the anchor plate.

6 Claims, 6 Drawing Figures

Figure 1:
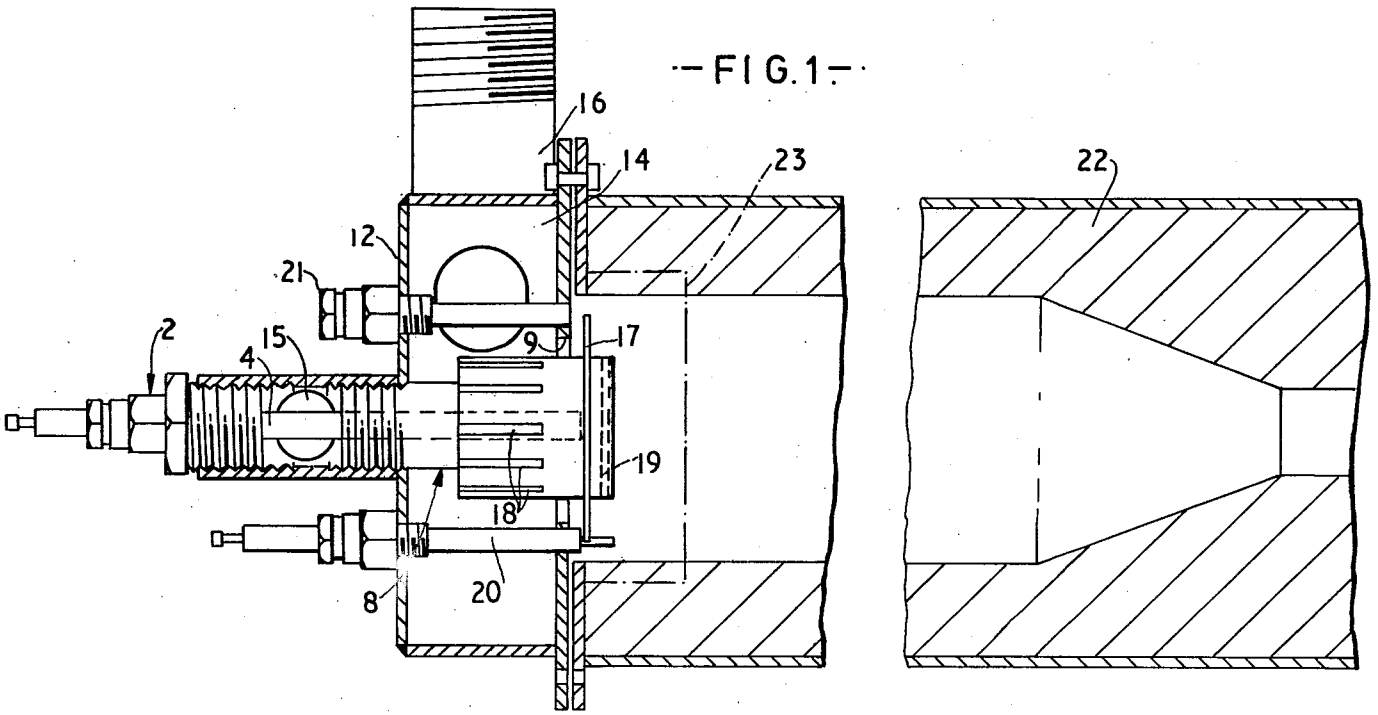

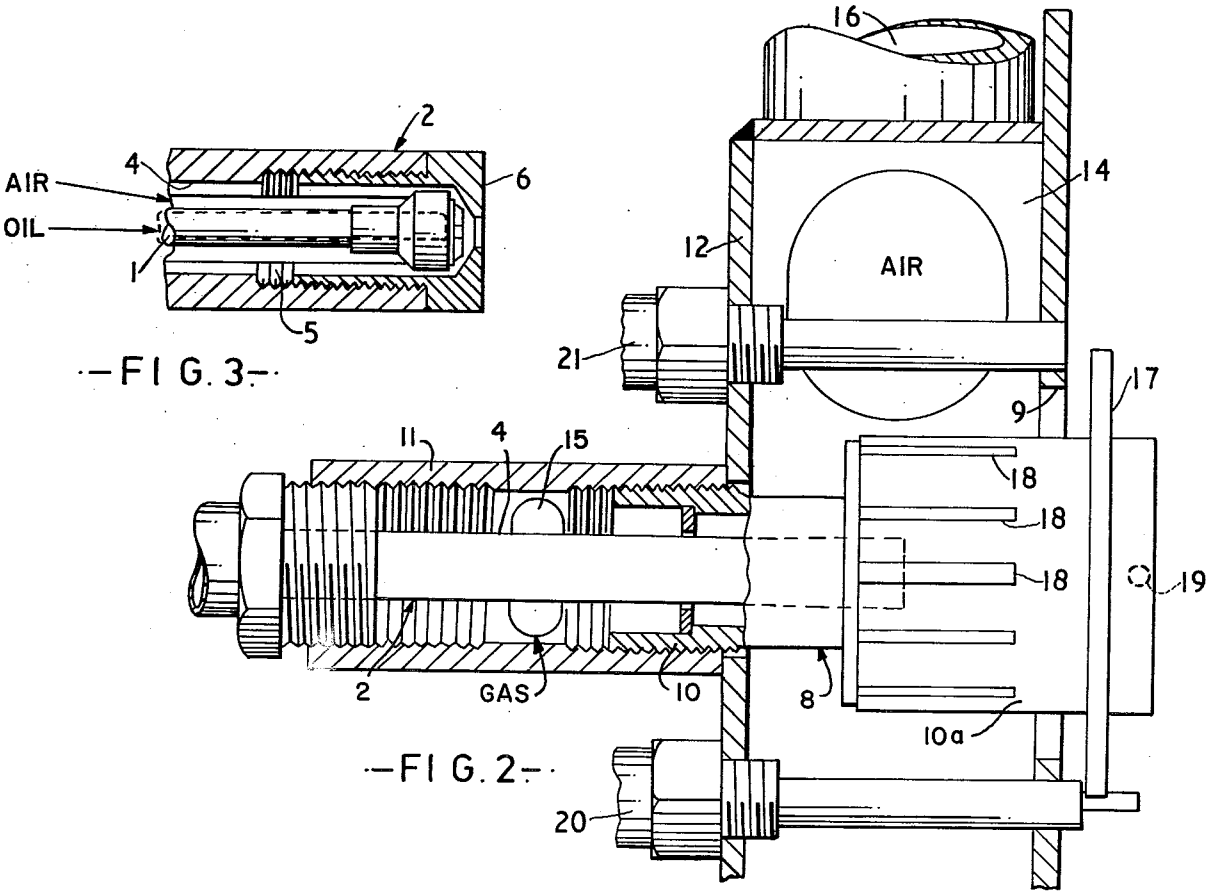
—FIG. 3—
—FIG. 2—

FUEL BURNERS

This application is a continuation in part of Ser. No. 531,187 filed on Dec. 9, 1974 and now abandoned.

The present invention relates to fluent fuel burners of the industrial type operating with forced draught and operable against a back pressure. Such a burner can be used to deliver a high velocity stream of hot combustion products into a furnace or other enclosure so that the stream distributes itself by its momentum and causes more uniform heating of the enclosure. In such a high velocity or tunnel burner, combustion takes place in a quarl having a restricted outlet and the back pressure in the quarl supplies kinetic energy to the stream.

A first aspect of the present invention provides a burner for fluent fuels comprising a combustion chamber having an aperture at one end through which the hot combustion gases are to exit and fuel and air supply means at the other end, the supply means comprising a fuel introduction means and a plenum having a wall on its chamber side with a hole in said wall and the plenum surrounding the introduction means, the introduction means having a larger diameter discharge end portion extending from within the plenum through the hole with clearance and having slots putting the interior of that portion into communication with the plenum so that air from the plenum flows into that portion to serve as primary combustion air and to support initial combustion in that portion, and a transverse flame anchor plate associated with that portion and closely neighbouring the said wall so as to define a restricted passage around the rim of the anchor plate through which passage secondary air from the plenum will exit at high velocity and consequentially reduced pressure creating a suction effect holding the flame on the anchor plate.

The flame anchor plate can overlie the wall so that the secondary air is caused to flow substantially radially outwardly and the overlying portion of the anchor plate can be perforated so that suction occurs over the whole of this portion and not merely at the rim or the flame anchor plate can be in the plane of the said wall so that the secondary air issues as a cylindrical jet. A radially issuing jet of secondary air can be directed by the wall of the combustion chamber to sweep back to aid keeping the flame concentrated and thus further improving combustion. However in burners using liquid fuels, particularly at low power, there is a tendency for the fuel to run over the anchor plate, re-atomise in the secondary air but then as the jet is deflected by the chamber wall to be centrifuged out onto the chamber wall. The use of the cylindrical jet of secondary air avoids this centrifuging problem. It is of course possible to reach a compromise between radial and cylindrical jets of secondary air.

Another aspect of the present invention provides a burner for fluent fuels comprising a substantially internally cylindrical combustion chamber having an aperture at one end through which the hot combustion gases are to exit and fuel and air supply means at the other end substantially coaxial with the chamber, said supply means comprising a central oil fuel introduction lance, primary combustion air supply means surrounding the lance, a gaseous fuel introduction means about the said primary air supply means and a plenum surrounding the gaseous fuel introduction means and having a wall on the combustion chamber side with a hole therein, the gaseous fuel introduction means having a larger diameter discharge end portion extending from within the plenum through the said hole with clearance and having slots therein putting the interior of that portion into communication with the plenum so that air from the plenum flows into that portion to serve as primary combustion air for the gaseous fuel to support combustion in said portion, and a flame anchor plate associated with that portion and closely neighbouring the said wall so as to define a restricted air passage for secondary air from the plenum whereby the secondary air emerges at high velocity and consequentially reduced pressure around the rim of the anchor plate to hold the flame on the anchor plate.

Figure 4:
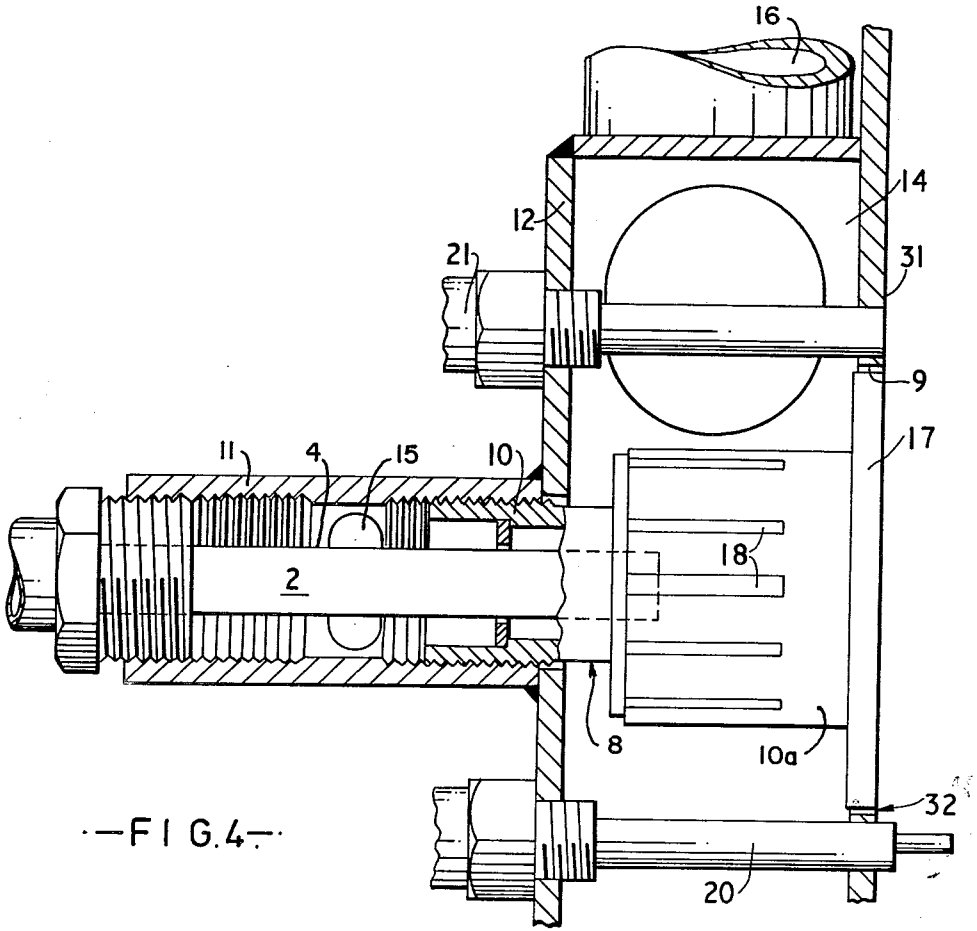
Figure 6:
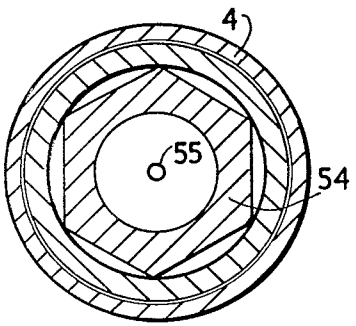
Figure 5:
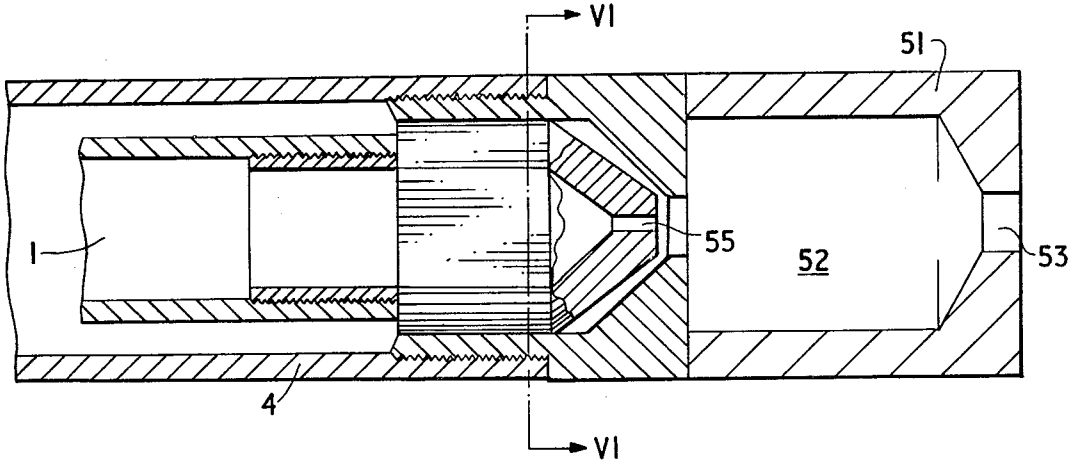

Embodiments of the invention will now be described, by way of example, with reference to the accompanying drawings in which:

FIG. 1 is an axial section through a burner in a quarl or combustion chamber, FIG. 2 is an enlarged detail view of the air and fuel introduction means of FIG. 1, FIG. 3 is a still further enlarged view of the tip of an oil lance, FIG. 4 is an axial section of an alternative form of burner in a quarl or combustion chamber, FIG. 5 is an enlarged view in cross-section of the tip of an oil lance, and FIG. 6 is a section on line VI — VI of the oil lance tip shown in FIG. 5.

A central duct 1 of an oil lance 2 terminates in a line of fine orifices or apertures for delivering a heavy fuel oil or pulverised solid fuel in an inflammable carrier atomised by the pressure of the fuel or by compressed air in the form of a fan tail spray and is surrounded by an associated primary air supply duct means 4. This means includes a block 5 containing a plurality of helical passages of between 1 and 5 turns per inch pitch (2 turns per inch seems particularly advantageous). The means 4 terminates in an orifice plug 6 which ends with an internal conical surface inclined more steeply to the axis of the lance than the end of the central duct so that the narrowest gap between the central duct and the conical surface is adjacent to the fine orifices with the result that the air swirling as a result of the block blasts across the issuing oil further atomising the fuel. The plug is preferably screw adjustable in the duct means 4 and can be set by relating the air flow rate to a given value at a predetermined source pressure, in a particular example a flow rate of 285 cubic feet of air per minute with a source pressure of 40 pounds per square inch guage and a back pressure of 10 pounds per square inch guage.

Surrounding the lance 2 is a gaseous fuel inlet means 8 in the form of a stepped tube whose minor diameter portion 10 is engaged for screw displacement with internal threads of a hollow boss 11 which may be welded to the rear wall 12 of an air plenum 14 as in FIG. 4. The gas fuel is introduced through an inlet 15 and flows on the inside of the means 8 and air is introduced into the plenum through an inlet 16. The larger diameter portion **10*a* of the fuel inlet means 8 extends from within the plenum through a hole 9 in the front wall of the plenum and forms the discharge end portion of the fuel and air supply means. The lance 2 terminates in the enlarged diameter portion 10*a*. Slots 18 are provided in the larger diameter portion through which a metered flow of primary air for the gaseous fuel enters the larger diameter portion to support combustion therein. These slots are not radial but are inclined tangentially so as to swirl this primary air either in the same or opposite sense to the swirl of the oil. A flame anchor plate 17 integral with the larger diameter portion 10a at about one inch from its free end overlies the periphery of the hole 9 defining a restricted radial passage from which a metered flow of secondary air from the plenum exits at high velocity and consequentially reduced pressure thus creating a suction effect at the rim of the anchor plate to hold the flame onto the anchor plate over its full radial extent. This suction effect can be assisted by fine holes in the overlying part of the anchor plate since the flame will tend to be sucked by the low pressure behind the anchor plate onto the anchor plate. An ignition electrode 20 and a sight glass 21 are provided. The means 8** is set according to the desired conditions and the gas fuel used.

The plenum is mounted on a combustion chamber or quarl 22 of a ceramic material reinforced by embedded steel or other reinforcements or of steel by a bolted gasketed joint but is preferably captive on hinges so that for servicing the plenum and the air and fuel introduction means, the plenum can be merely unbolted and hinged back.

Instead of having the means 8 and the anchor plate adjustable in position relative to the plenum and so having the restricted passage adjustable, it is possible to mount the anchor plate from the plenum with a fixed spacing of, say, 0.060 inches and have the minor diameter portion 10 a push fit in the remainder of the fuel and air supply means, the rear wall of the plenum being sealed to the portion 10.

The swirling of the two sets of primary air will tend to a thorough mixture of the fuel being used and the primary air and will also tend to attach the flame to the wall of the anchor plate which being heated by the flame will tend to vaporise any large fuel droplets centrifuged against the plate by the swirl. The remainder of the air flowing over the outside of the means 8 through the restricted passage behind the plate and issuing at high velocity and consequentially reduced pressure, will tend to draw the flame towards the rim of the anchor plate. This issuing air can also be given a swirl in either direction and whilst it is preferred that the issuing air flow is radial, it can have an axial component of movement. This air flow is preferably radial in order that it can be used to cool the wall of the quarl which as shown in chain dot lines 23 can be stepped so that most of this air sweeps back in a tertiary blast blowing the flame back onto the anchor plate and further concentrating the flame and improving combustion. A minor part of this air does remain attached to the wall of the quarl holding down its temperature and enabling the size of the quarl's exit hole to be very small so that the combustion products can exit at high velocity, say, 1000 feet per second.

It has already been said that pulverised solid fuel can be used by mixing it with an inflammable liquid carrier and delivering it through the oil jet; it is also possible to use pulverised fuel by mixing it with air and delivering it through an air supply or gaseous fuel aperture.

The burner so far described has many advantages. Due to the turbulence of the primary air fuel mixtures, due to the localisation and concentration of the flame by the improved anchor plate arrangement and the air flows so that the flame is hotter, and due to the cooling of the anchor plate and quarl by the secondary air flow so that no restriction is forced on the design by these components, the flame conditions can be nearer the ideal and less excess air is needed which itself improves the conditions since the flame temperature is higher; any unburnt fuel escaping into the secondary air is at an extremely high temperature and readily burns in the secondary air. Thus there is a high burning efficiency. Moreover the burner can be compact. Due to the physical arrangement, any leakage due to failure of the gasket or of the plenum chamber will be air not flame (as occurs in some burners and results in the burning away of such burners). Adjustment of the outlet temperature can be achieved by adjusting the amount of excess secondary air by movement of the anchor plate. Furthermore, due to the ideal flame conditions, the turn-down ratio of the burner (the ratio of maximum to minimum fuel consumption) is surprisingly high, a value of 10:1 has been achieved.

However it must be admitted that with oil burners turned down, unburnt oil builds up on the wall of the quarl showing that there is expectedly a fall-off in burning efficiency. It is thought that this might be due to oil running over the anchor plate and whilst this oil will be re-atomised at the rim by the secondary air, it is probably centrifuged out by the rapid change of direction of the secondary air. The embodiment of FIG. 4 is intended for oil burners demanding a high turn-down ratio and prolonged operation when turned down. This embodiment is very similar to the first embodiment so like parts have been given the same reference numerals. The main difference is that the hole 9 is larger and the anchor plate 17 lies in the plane of the front wall 31 of the plenum. The anchor plate is, for example, made integral with the front wall being separated therefrom by a 0.030 inch gap 32 (apart from small spiders joining the anchor plate to the wall and locating the anchor plate. Thus the secondary air emerges not as a radial jet but in a cylindrical jet but still at high velocity and consequentially reduced pressure so that the flame is sucked to the rim of the anchor plate. Any oil flowing over the anchor plate is atomised by this cylindrical jet of secondary air; this atomised oil is of course at the junction between the primary air and secondary air and tends to return to the hot flame instead of staying in the cold secondary air. The wall of the quarl adjacent the plenum is not cooled by a blast of secondary air as when the secondary air emerges in a radial jet and runs hotter; this is an alternative or supplementary reason for the reduction observed in oil build up on this part of the quarl wall and for the increase in burning efficiency. It has been noted that the secondary air is considerably preheated in this embodiment and this is sometimes an advantage (particularly when burning liquid fuels) and sometimes a disadvantage (sometimes necessitating higher air pressures when burning gaseous fuels).

If is of course possible to alter either described embodiment so that the high velocity, reduced pressure, air exits in a blast which is neither radial nor axial (cylindrical) but is somewhere inbetween. For example, in the embodiment of FIG. 4, the anchor plate can be dished out with the spiders extending obliquely with respect to said front wall.

FIGS. 5 and 6 show an alternative form of oil lance tip. As in FIG. 3, a central oil duct 1 is surrounded by a primary air supply means 4. The main difference is that the lance has a cap 51 defining a space 52 into which the lance proper discharges its oil-in-air mist and a jet orifice 53 from which the mist is discharged. Care is taken to centralise the duct 1 within the means 4 as by having a hexagonal oil jet orifice plug 54 forming the end of the duct with the corners of the plug locating in the means 4; this divides the air into six substantially equal streams evenly spaced about the axis of the duct 1. Nevertheless, circumstances can be envisaged wherein the oil mist or the air wanders to one side. The cap 51 acts as a collimator so that the oil-in-air mist leaves the lance strictly axially. The plug can have a single atomising orifice 55.

The dual fuel burners shown in the drawings are supplied with air and fuel through pipelines (not shown) and their pressures controlled and measured on entry to the burners. The invention is of course not limited to dual fuel burners.

The invention relies on close spacing of the anchor plate with respect to the front wall of the plenum. The closeness of this spacing depends on the precise construction of the burner and should be close enough to give the desired effect. However as guidance, a spacing of between 0.020 inches and 0.100 inches is required and between 0.025 and 0.060 inches is probably right for most burners.

I claim:

1. A fluent fuel burner of the industrial type operating with forced draught and operable against a back pressure, comprising a combustion chamber, a central fuel and primary air introduction means having an enlarged diameter discharge end portion, an air plenum surrounding the said means with a wall separating the air in the plenum from the combustion chamber and with a hole in said wall through which said portion penetrates with clearance, said portion having apertures putting the plenum into direct communication with the inside of the portion for the metered supply of primary air thereinto which apertures are tangentially so inclined to the axis of the enlarged end that the primary air swirls about that axis, and a flame anchor plate extending from said end portion across the hole to neighbour said wall closely and to seal said hole except for a passage around the rim of the anchor plate which passage is so narrow that secondary air from the plenum has to force its way through at a high speed, and consequentially reduced pressure, such that a suction effect is created holding the flame on the rim of the anchor plate.

2. A burner according to claim 1 in which the anchor plate lies within the plane of said wall with the restricted passage directing the secondary air into a cylindrical jet.

3. A burner according to claim 1 in which the said apertures are in the form of slots.

4. A burner according to claim 1 in which the said introduction means comprises a central oil fuel introduction lance, primary oil-combustion air supply means surrounding the lance, and a gaseous fuel introduction means about the air supply means.

5. A fluent fuel burner of the industrial type operating with a forced draught and operable against a back pressure, comprising a combustion chamber, a central fuel and primary air introduction means extending into said combustion chamber, an air plenum surrounding the said means, the plenum having a wall separating the air in the plenum from the combustion chamber, with a hole in said wall through which the said means penetrates with clearance, and a flame anchor plate extending from said means across the hole to neighbour and overlap the wall closely and to seal the said hole except for a narrow annular passage through which air from the plenum has to force its way radially at a high speed, and consequentially reduced pressure, such that a suction effect is created holding the flame onto the rim of the anchor plate.

6. An oil lance for use in a burner according to claim 5 wherein said fuel and primary introduction means comprises a central oil duct terminating in an oil jet orifice plug for delivering the oil in an atomised spray, a primary air introduction means surrounding the duct and directing the air into the spray, and a cap defining a space into which the air and oil enter and from which they exit through an axial orifice.

* * * * *